US012037774B2

(12) United States Patent
Kondo et al.

(10) Patent No.: US 12,037,774 B2
(45) Date of Patent: Jul. 16, 2024

(54) HYDRAULIC EXCAVATOR DRIVE SYSTEM

(71) Applicant: KAWASAKI JUKOGYO KABUSHIKI KAISHA, Kobe (JP)

(72) Inventors: Akihiro Kondo, Kobe (JP); Hideyasu Muraoka, Kobe (JP); Yoshiyuki Tode, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/914,599

(22) PCT Filed: Apr. 28, 2021

(86) PCT No.: PCT/JP2021/016953
§ 371 (c)(1),
(2) Date: Sep. 26, 2022

(87) PCT Pub. No.: WO2021/235207
PCT Pub. Date: Nov. 25, 2021

(65) Prior Publication Data

US 2023/0228063 A1 Jul. 20, 2023

(30) Foreign Application Priority Data

May 18, 2020 (JP) ..... 2020-086388

(51) Int. Cl.
*E02F 9/22* (2006.01)
*E02F 9/20* (2006.01)

(52) U.S. Cl.
CPC ..... *E02F 9/2292* (2013.01); *E02F 9/2037* (2013.01); *E02F 9/2242* (2013.01); *E02F 9/2267* (2013.01); *E02F 9/2289* (2013.01); *E02F 9/2004* (2013.01); *E02F 9/2217* (2013.01)

(58) Field of Classification Search
CPC ..... E02F 9/2289; E02F 3/435; E02F 9/2292; F15B 11/02
See application file for complete search history.

(56) References Cited

U.S. PATENT DOCUMENTS 5,970,709 A * 10/1999 Tohji ..... E02F 9/2292 60/429
2015/0292183 A1 10/2015 Hiraku

FOREIGN PATENT DOCUMENTS

JP 2015-206415 A 11/2015
WO 2014/109131 A1 7/2014
WO WO-2014109131 A1 * 7/2014 ..... E02F 9/2217

* cited by examiner

*Primary Examiner* — Abiy Teka
(74) *Attorney, Agent, or Firm* — Oliff PLC

(57) ABSTRACT

A hydraulic excavator drive system includes: a first pump that is connected to a head-side chamber of a boom cylinder by a head-side line and to a rod-side chamber of the boom cylinder by a rod-side line to form a closed circuit; and a second pump that supplies hydraulic oil to at least one of an arm cylinder or a bucket cylinder. The hydraulic excavator drive system further includes a switching valve located on a relay line that connects a supply line extending from the second pump to the rod-side line. The switching valve opens the relay line at a boom raising operation and blocks the relay line except at the boom raising operation.

4 Claims, 3 Drawing Sheets

HYDRAULIC EXCAVATOR DRIVE SYSTEM

CROSS-REFERENCE TO RELATED APPLICATIONS

This is a U.S. National Phase of Application No. PCT/JP2021/016953 filed Apr. 28, 2021, which claims the benefit of Japanese Application No. 2020-086388 filed May 18, 2020. The disclosure of the prior applications is hereby incorporated by reference herein in its entirety.

TECHNICAL FIELD

The present disclosure relates to a hydraulic excavator drive system.

BACKGROUND ART

Generally speaking, in a hydraulic excavator, an arm is swingably coupled to the distal end of a boom that is luffed relative to a slewing structure, and a bucket is swingably coupled to the distal end of the arm. A drive system mounted in such a hydraulic excavator includes, for example, a boom cylinder that luffs the boom, an arm cylinder that swings the arm, and a bucket cylinder that swings the bucket. These hydraulic actuators are supplied with hydraulic oil from a pump.

For example, Patent Literature 1 discloses a hydraulic excavator drive system in which a closed circuit is used for a boom cylinder, and an open circuit is used for each of an arm cylinder and a bucket cylinder. In such a case where a closed circuit is used for the boom cylinder, the potential energy of the boom can be regenerated at a boom lowering operation.

Specifically, in the hydraulic excavator drive system disclosed by Patent Literature 1, a head-side chamber and a rod-side chamber of the boom cylinder are connected to a first pump by a head-side line and a rod-side line, respectively. The arm cylinder is connected to a second pump and a tank via an arm control valve. The bucket cylinder is connected to a third pump and the tank via a bucket control valve.

Further, in the hydraulic excavator drive system disclosed by Patent Literature 1, an arm supply line between the second pump and the arm control valve is connected, by a relay line, to the head-side line between the head-side chamber of the boom cylinder and the first pump. A switching valve is located on the relay line. The switching valve is opened at a boom raising operation, and as a result, the hydraulic oil delivered from the second pump is supplied to the head-side chamber of the boom cylinder together with the hydraulic oil delivered from the first pump.

CITATION LIST

Patent Literature

PTL 1: Japanese Laid-Open Patent Application Publication No. 2015-206415

SUMMARY OF INVENTION

Technical Problem

However, in the hydraulic excavator drive system disclosed by Patent Literature 1, the hydraulic oil delivered from the second pump at the boom raising operation is supplied to the head-side chamber of the boom cylinder. This causes increase in the delivery pressure of the second pump, and motive power required for driving the second pump increases, accordingly.

An object of the present disclosure is to provide a hydraulic excavator drive system that makes it possible to, at the boom raising operation, reduce motive power for the second pump that supplies the hydraulic oil to the closed circuit for the boom cylinder.

Solution to Problem

In order to solve the above-described problems, a hydraulic excavator drive system according to the present disclosure includes: a first pump that is connected to a head-side chamber of a boom cylinder by a head-side line and to a rod-side chamber of the boom cylinder by a rod-side line to form a closed circuit; a second pump that supplies hydraulic oil to at least one of an arm cylinder or a bucket cylinder; and a switching valve located on a relay line that connects a supply line extending from the second pump to the rod-side line, wherein the switching valve opens the relay line at a boom raising operation and blocks the relay line except at the boom raising operation.

According to the above configuration, the relay line is connected to the rod-side line whose pressure is lowered at the boom raising operation. Accordingly, at the boom raising operation, motive power for the second pump, which supplies the hydraulic oil to the closed circuit for the boom cylinder, can be reduced.

ADVANTAGEOUS EFFECTS OF INVENTION

The present disclosure makes it possible to, at the boom raising operation, reduce motive power for the second pump that supplies the hydraulic oil to the closed circuit for the boom cylinder.

DESCRIPTION OF EMBODIMENTS

Figure 1:
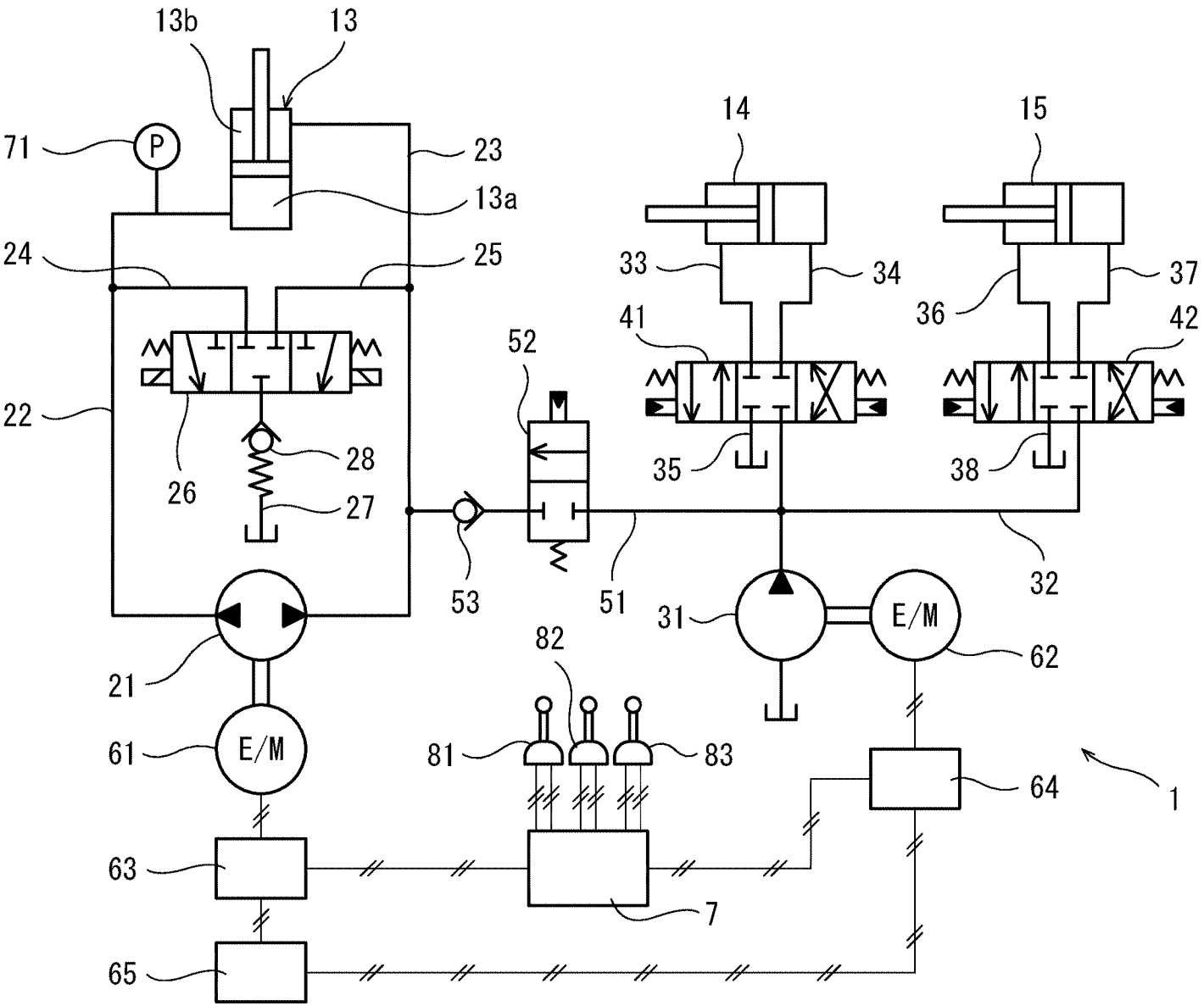
FIG. 1 shows a schematic configuration of a hydraulic excavator drive system according to one embodiment of the present disclosure.
Figure 2:
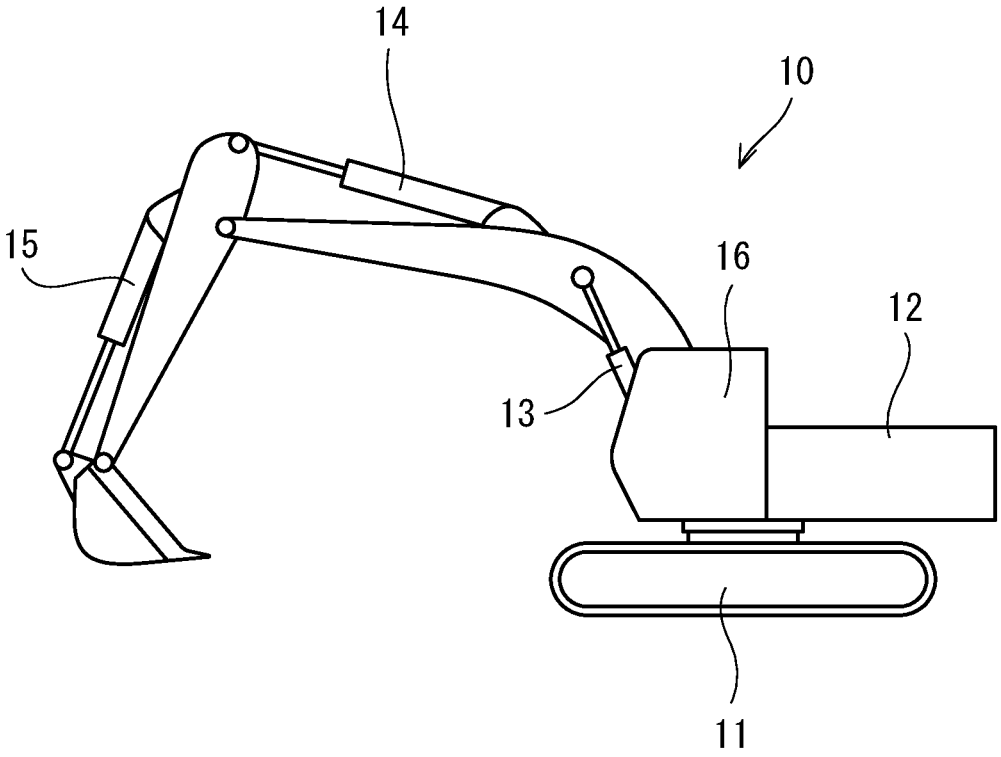
FIG. 2 is a side view of a hydraulic excavator.

FIG. 1 shows a hydraulic excavator drive system 1 according to one embodiment of the present disclosure. FIG. 2 shows a hydraulic excavator 10, in which the drive system 1 is mounted.

The hydraulic excavator 10 shown in FIG. 2 is a self-propelled hydraulic excavator, and includes a traveling structure 11. The hydraulic excavator 10 further includes a slewing structure 12 and a boom. The slewing structure 12 is slewably supported by the traveling structure 11. The boom is luffed relative to the slewing structure 12. An arm is swingably coupled to the distal end of the boom, and a bucket is swingably coupled to the distal end of the arm. The slewing structure 12 includes a cabin 16. The cabin 16 includes a driver's seat. The hydraulic excavator 10 need not be of a self-propelled type.

As shown in FIG. 1, the drive system 1 includes a boom cylinder 13, an arm cylinder 14, and a bucket cylinder 15 as hydraulic actuators. As shown in FIG. 2, the boom cylinder 13 luffs the boom. The arm cylinder 14 swings the arm. The bucket cylinder 15 swings the bucket. An unshown slewing motor and an unshown pair of left and right travel motors may be included either in the drive system 1 or in a different drive system.

The drive system 1 further includes a first pump 21 for the boom cylinder 13 and a second pump 31 for the arm cylinder 14 and the bucket cylinder 15. The first pump 21 is driven by a first electric motor 61 to rotate in one direction and the opposite direction. The second pump 31 is driven by a second electric motor 62 to rotate in one direction.

The first pump 21 is connected to a head-side chamber 13*a* of the boom cylinder 13 by a head-side line 22 and to a rod-side chamber 13*b* of the boom cylinder 13 by a rod-side line 23 to form a closed circuit. At a boom raising operation, the first pump 21 rotates in one direction to supply the hydraulic oil to the head-side chamber 13*a* through the head-side line 22, and at a vehicle body lifting operation, the first pump 21 rotates in the opposite direction to supply the hydraulic oil to the rod-side chamber 13*b* through the rod-side line 23. At a boom lowering operation, the first pump 21 is driven as a hydraulic motor.

The head-side line 22 is connected to a switching valve 26 (corresponding to a second switching valve of the present disclosure) by a head-side branch line 24, and the rod-side line 23 is connected to the switching valve 26 by a rod-side branch line 25. The switching valve 26 is connected to the tank by a tank line 27. A check valve 28 having a predetermined cracking pressure (e.g., 0.1 to 3.0 MPa) is located on the tank line 27.

The switching valve 26 is switched between a neutral position, a head-side discharge position (left-side position in FIG. 1), and a rod-side discharge position (right-side position in FIG. 1). When the switching valve 26 is in the neutral position, the switching valve 26 blocks the head-side branch line 24, the rod-side branch line 25, and the tank line 27. When the switching valve 26 is in the head-side discharge position, the switching valve 26 blocks the rod-side branch line 25 and brings the head-side branch line 24 into communication with the tank line 27. When the switching valve 26 is in the rod-side discharge position, the switching valve 26 blocks the head-side branch line 24 and brings the rod-side branch line 25 into communication with the tank line 27.

In the present embodiment, the switching valve 26 moves in accordance with an electrical signal. The switching valve 26 is controlled by a below-described controller 7. At a boom raising operation, the switching valve 26 is in the neutral position. At a boom lowering operation, the switching valve 26 is switched to the rod-side discharge position. At a vehicle body lifting operation, the switching valve 26 is switched to the head-side discharge position. In the description herein, an operation of lowering the boom when the bucket is in the air is referred to as "boom lowering operation" and an operation of lifting the body (i.e., the traveling structure 11 and the slewing structure 12) of the hydraulic excavator by pushing the bucket against, for example, the ground is referred to as "vehicle body lifting operation".

The second pump 31 supplies the hydraulic oil to the arm cylinder 14 via an arm control valve 41, and supplies the hydraulic oil to the bucket cylinder 15 via a bucket control valve 42. The second pump 31 is connected to the arm control valve 41 and the bucket control valve 42 by a supply line 32. In other words, the supply line 32 extends from the second pump 31, and branches into multiple lines that connect to the arm control valve 41 and the bucket control valve 42, respectively.

It is not essential for the second pump 31 to supply the hydraulic oil to both the arm cylinder 14 and the bucket cylinder 15. Instead, the second pump 31 may supply the hydraulic oil to either the arm cylinder 14 or the bucket cylinder 15. For example, in a case where the second pump 31 supplies the hydraulic oil only to the arm cylinder 14, the bucket cylinder 15 may be supplied with the hydraulic oil from a third pump.

The arm control valve 41 controls the supply and discharge of the hydraulic oil to and from the arm cylinder 14. The arm control valve 41 is connected to the arm cylinder 14 by a pair of supply/discharge lines 33 and 34, and to the tank by a tank line 35.

Similarly, the bucket control valve 42 controls the supply and discharge of the hydraulic oil to and from the bucket cylinder 15. The bucket control valve 42 is connected to the bucket cylinder 15 by a pair of supply/discharge lines 36 and 37, and to the tank by a tank line 38.

In the present embodiment, each of the arm control valve 41 and the bucket control valve 42 moves in accordance with a pilot pressure. A pair of pilot ports of the arm control valve 41 is connected to an unshown pair of solenoid proportional valves, respectively. A pair of pilot ports of the bucket control valve 42 is connected to an unshown pair of solenoid proportional valves, respectively. Each of the arm control valve 41 and the bucket control valve 42 is controlled by the below-described controller 7 via the aforementioned pair of solenoid proportional valves.

Alternatively, each of the arm control valve 41 and the bucket control valve 42 may move in accordance with an electrical signal. In this case, each of the arm control valve 41 and the bucket control valve 42 is directly controlled by the controller 7.

The supply line 32 is connected to the rod-side line 23 of the aforementioned closed circuit for the boom cylinder 13 by a relay line 51. A switching valve 52 (corresponding to a first switching valve of the present disclosure) is located on the relay line 51.

The switching valve 52 is switched between a normal position (lower position in FIG. 1; a neutral position in the present embodiment) and an offset position (upper position in FIG. 1). When the switching valve 52 is in the normal position, the switching valve 52 blocks the relay line 51. When the switching valve 52 is in the offset position, the switching valve 52 opens the relay line 51.

In the present embodiment, the switching valve 52 moves in accordance with a pilot pressure. A pilot port of the switching valve 52 is connected to an unshown solenoid proportional valve. The switching valve 52 is configured such that when the switching valve 52 is in the offset position, the higher the pilot pressure, the greater the opening area of the switching valve 52. The switching valve 52 is controlled by the controller 7 via the aforementioned solenoid proportional valve. Alternatively, the switching valve 52 may move in accordance with an electrical signal.

At a boom raising operation, the switching valve 52 is switched to the offset position. Except at the boom raising operation, the switching valve 52 is in the normal position. Accordingly, the hydraulic oil flows to the relay line 51 only at the boom raising operation.

A check valve 53 is located on the relay line 51. At the boom raising operation, the check valve 53 allows a flow from the second pump 31 toward the rod-side line 23, but prevents the reverse flow. In the illustrated example, the check valve 53 is positioned downstream of the switching valve 52. Alternatively, the check valve 53 may be positioned upstream of the switching valve 52. Further alternatively, the check valve 53 may be included (incorporated) in the switching valve 52.

The above-described first electric motor 61 and second electric motor 62 are connected to a battery 65 via an inverter 63 and an inverter 64, respectively. Specifically, when the first electric motor 61 drives the first pump 21, the battery 65 supplies electric power to the first electric motor 61. When the second electric motor 62 drives the second pump 31, the battery 65 supplies electric power to the second electric motor 62. The first electric motor 61 and the second electric motor 62 are controlled by the controller 7 via the inverter 63 and the inverter 64, respectively. The battery 65 may be a capacitor.

The cabin 16 includes therein a boom operator 81, an arm operator 82, and a bucket operator 83. The boom operator 81 includes an operating lever that is operated in a boom raising direction and a boom lowering direction. The arm operator 82 includes an operating lever that is operated in an arm crowding direction and an arm pushing direction. The bucket operator 83 includes an operating lever that is operated in a bucket excavating direction and a bucket dumping direction. Each of the boom operator 81, the arm operator 82, and the bucket operator 83 outputs an operation signal corresponding to an operating direction and an operating amount (an inclination angle) of the operating lever.

Specifically, when the operating lever of the boom operator 81 is operated in the boom raising direction, the boom operator 81 outputs a boom raising operation signal corresponding to the operating amount of the operating lever, and when the operating lever of the boom operator 81 is operated in the boom lowering direction, the boom operator 81 outputs a boom lowering operation signal corresponding to the operating amount of the operating lever. Similarly, when the operating lever of the arm operator 82 is operated in the arm crowding direction or the arm pushing direction, the arm operator 82 outputs an arm operation signal (an arm crowding operation signal or an arm pushing operation signal) corresponding to the operating amount of the operating lever, and when the operating lever of the bucket operator 83 is operated in the bucket excavating direction or the bucket dumping direction, the bucket operator 83 outputs a bucket operation signal (a bucket excavating operation signal or a bucket dumping operation signal) corresponding to the operating amount of the operating lever.

In the present embodiment, each of the boom operator 81, the arm operator 82, and the bucket operator 83 is an electrical joystick that outputs an electrical signal as an operation signal. Alternatively, each of the arm operator 82 and the bucket operator 83 may be a pilot operation valve that outputs a pilot pressure as an operation signal. In this case, the pair of pilot ports of the arm control valve 41 may be connected the arm operator 82, and the pair of pilot ports of the bucket control valve 42 may be connected to the bucket operator 83.

Operation signals (electrical signals) outputted from the boom operator 81, the arm operator 82, and the bucket operator 83 are inputted to the controller 7. For example, the controller 7 is a computer including memories such as a ROM and RAM, a storage such as a HDD, and a CPU. The CPU executes a program stored in the ROM or HDD.

When an arm operation signal is outputted from the arm operator 82 (i.e., at an arm operation), the controller 7 controls the arm control valve 41 via an unshown solenoid proportional valve, such that the greater the operating amount of the operating lever of the arm operator 82, the greater the opening area of the arm control valve 41. Regarding the rotation speed of the second electric motor 62, in a case where only the operating lever of the arm operator 82 is operated, the controller 7 may adjust the rotation speed of the second electric motor 62 via the inverter 64, such that the greater the operating amount of the operating lever of the arm operator 82, the higher the delivery flow rate of the second pump 31. Alternatively, the rotation speed of the second electric motor 62 may be constant.

Similarly, when a bucket operation signal is outputted from the bucket operator 83 (i.e., at a bucket operation), the controller 7 controls the bucket control valve 42 via an unshown solenoid proportional valve, such that the greater the operating amount of the operating lever of the bucket operator 83, the greater the opening area of the bucket control valve 42. Regarding the rotation speed of the second electric motor 62, in a case where only the operating lever of the bucket operator 83 is operated, the controller 7 may adjust the rotation speed of the second electric motor 62 via the inverter 64, such that the greater the operating amount of the operating lever of the bucket operator 83, the higher the delivery flow rate of the second pump 31. Alternatively, the rotation speed of the second electric motor 62 may be constant.

When a boom raising operation signal is outputted from the boom operator 81 (i.e., at a boom raising operation), the controller 7 rotates the first electric motor 61 in one direction via the inverter 63, such that the first pump 21 delivers the hydraulic oil through the head-side line 22. Also, at the boom raising operation, the controller 7 adjusts the rotation speed of the first electric motor 61 via the inverter 63, such that the greater the operating amount of the operating lever of the boom operator 81, the higher the delivery flow rate of the first pump 21.

Further, at the boom raising operation, the controller 7 switches the switching valve 52 to the offset position via the unshown solenoid proportional valve. Then, the controller 7 adjusts the rotation speed of the second electric motor 62 in accordance with the operating amount of the operating lever of the boom operator 81. For example, at the boom raising operation, if neither the arm operator 82 nor the bucket operator 83 is being operated, the controller 7 adjusts the rotation speed of the second electric motor 62 via the inverter 64, such that the greater the operating amount of the operating lever of the boom operator 81, the higher the delivery flow rate of the second pump 31.

Also, at the boom raising operation, if neither an arm operation nor a bucket operation is performed concurrently with the boom raising operation, the controller 7 controls the switching valve 52 via the unshown solenoid proportional valve to maximize the opening area of the switching valve 52 regardless of the operating amount of the operating lever of the boom operator 81.

On the other hand, if an arm operation is performed concurrently with the boom raising operation, the controller 7 calculates a flow rate at which the hydraulic oil is to be supplied for the boom raising operation and a flow rate at which the hydraulic oil is to be supplied to the arm side, controls the delivery flow rate of the second pump 31, and controls the switching valve 52 to adjust the opening area thereof to compensate for a pressure difference between the load pressure of the arm cylinder 14 and the pressure of the rod-side chamber 13*b* of the boom cylinder 13.

Through the above control, the hydraulic oil in an amount corresponding to an insufficiency in the hydraulic oil due to an area difference between the head-side chamber 13*a* and the rod-side chamber 13*b* of the boom cylinder 13 is supplied from the second pump 31 to the rod-side line 23 of the closed circuit for the boom cylinder 13.

The first pump 21 includes two ports to which the head-side line 22 and the rod-side line 23 are connected, respectively. For each of these two ports, there is a case where the port serves as a delivery-side port. For this reason, the passage area of each of these two ports is designed small as a high pressure port. However, in the case of adopting such a configuration, there is a risk of insufficiency in the suction capacity of the first pump 21. In this respect, in the present embodiment, the hydraulic oil is supplied from the second pump 31 to the suction side of the first pump 21, and thereby the insufficiency in the suction capacity of the first pump 21 can be compensated for.

When a boom lowering operation signal is outputted from the boom operator 81, the controller 7 determines which one of a boom lowering operation or a vehicle body lifting operation has been performed. In the present embodiment, the controller 7 is electrically connected to a pressure sensor 71, which detects a pressure Ph of the head-side chamber 13*a* of the boom cylinder 13. In the illustrated example, the pressure sensor 71 is located on the head-side line 22. Alternatively, the pressure sensor 71 may be located on the head-side chamber 13*a* of the boom cylinder 13.

In a case where the boom lowering operation signal is outputted from the boom operator 81 and the pressure Ph detected by the pressure sensor 71 is greater than a predetermined value (the predetermined value is set within the range of, for example, 0.5 to 10 MPa), the controller 7 determines that a boom lowering operation has been performed. On the other hand, in a case where the boom lowering operation signal is outputted from the boom operator 81 and the pressure Ph detected by the pressure sensor 71 is less than the predetermined value, the controller 7 determines that a vehicle body lifting operation has been performed. That is, when the pressure Ph detected by the pressure sensor 71 falls below the predetermined value during the operating lever of the boom operator 81 being operated in the boom lowering direction, the controller 7 determines that a vehicle body lifting operation has started.

A method of determining which one of a boom lowering operation or a vehicle body lifting operation has been performed when a boom lowering operation signal is outputted from the boom operator 81 is not limited to the above-described one. For example, in a case where the boom lowering operation signal is outputted from the boom operator 81 and a regenerative current generated by the first electric motor 61 is greater than a predetermined value, the controller 7 may determine that a boom lowering operation has been performed, and in a case where the boom lowering operation signal is outputted from the boom operator 81 and the regenerative current generated by the first electric motor 61 is less than the predetermined value, the controller 7 may determine that a vehicle body lifting operation has been performed. That is, when the regenerative current generated by the first electric motor 61 falls below the predetermined value during the operating lever of the boom operator 81 being operated in the boom lowering direction, the controller 7 may determine that a vehicle body lifting operation has started.

Alternatively, in a case where the boom lowering operation signal is outputted from the boom operator 81 and a pressure Pr of the rod-side chamber 13*b* of the boom cylinder 13 is lower than a predetermined value, the controller 7 may determine that a boom lowering operation has been performed, and in a case where the boom lowering operation signal is outputted from the boom operator 81 and the pressure Pr of the rod-side chamber 13*b* is higher than the predetermined value, the controller 7 may determine that a vehicle body lifting operation has been performed.

As another determining method, when the boom lowering operation signal is outputted from the boom operator 81, the controller 7 may monitor a deviation between a command rotation speed for the first electric motor 61 and an actual rotation speed of the first electric motor 61. The command rotation speed is calculated from the boom lowering operation signal. When the deviation is greater than an expected value, the controller 7 may determine that a vehicle body lifting operation has been performed.

At a boom lowering operation, the first pump 21 is driven as a hydraulic motor by the hydraulic oil discharged from the head-side chamber 13*a* of the boom cylinder 13. Accordingly, the first electric motor 61 functions as a power generator, and the potential energy of the boom is regenerated. The generated electric power is stored in the battery 65. At the boom lowering operation, the controller 7 reduces the regenerative torque (braking force) of the first electric motor 61 in accordance with increase in the operating amount of the operating lever of the boom operator 81.

Also at the boom lowering operation, the controller 7 switches the switching valve 26 to the rod-side discharge position. Accordingly, an excess amount of the hydraulic oil corresponding to an area difference between the head-side chamber 13*a* and the rod-side chamber 13*b* of the boom cylinder 13 is, after passing through the first pump 21, discharged from the closed circuit for the boom cylinder 13 to the tank through the rod-side branch line 25 and the tank line 27. Since the check valve 28 having the predetermined cracking pressure is located on the tank line 27, cavitation can be prevented from occurring at the rod-side chamber 13*b* and the rod-side line 23.

At a vehicle body lifting operation, the controller 7 switches the switching valve 26 to the head-side discharge position, and then rotates the first electric motor 61 via the inverter 63 in a rotation direction opposite to its rotation direction at a boom raising operation, such that the first pump 21 delivers the hydraulic oil through the rod-side line 23. Accordingly, an excess amount of the hydraulic oil corresponding to an area difference between the head-side chamber 13*a* and the rod-side chamber 13*b* of the boom cylinder 13 is, before passing through the first pump 21, discharged from the closed circuit for the boom cylinder 13 to the tank through the head-side branch line 24 and the tank line 27.

As described above, in the hydraulic excavator drive system 1 of the present embodiment, the relay line is connected to the rod-side line 23 whose pressure is lowered at a boom raising operation. Accordingly, at the boom raising operation, motive power for the second pump 31, which supplies the hydraulic oil to the closed circuit for the boom cylinder 13, can be reduced.

Moreover, in the present embodiment, the check valve 53 is located on the relay line 51. Therefore, even when the boom raising operation is performed concurrently with an arm operation or a bucket operation, a reverse flow of the hydraulic oil at the relay line 51 can be prevented.

Furthermore, in the present embodiment, since the switching valve 26 is controlled as described above, at a boom lowering operation, a part of the hydraulic oil discharged from the head-side chamber 13*a* of the boom cylinder (i.e., an excess amount of the hydraulic oil in excess of the amount of the hydraulic oil flowing into the rod-side chamber 13*b*) can be discharged to the tank after the excess amount of the hydraulic oil has passed through the first pump 21 (in other words, after energy recovery), whereas at a vehicle body lifting operation, the excess amount of the hydraulic oil can be discharged to the tank before it passes through the first pump 21.

Variations

The present disclosure is not limited to the above-described embodiment. Various modifications can be made without departing from the scope of the present disclosure.

For example, each of the first pump 21 and the second pump 31 may be a variable displacement pump, and the first pump 21 and the second pump 31 may be driven by the same engine. In this case, the first pump 21 is an over-center pump whose swash plate or tilted axis is tiltable from the reference axis bi-directionally. Even in a case where the first pump 21 and the second pump 31 are driven by the same engine, the potential energy of the boom is regenerated at a boom lowering operation.

Figure 3:
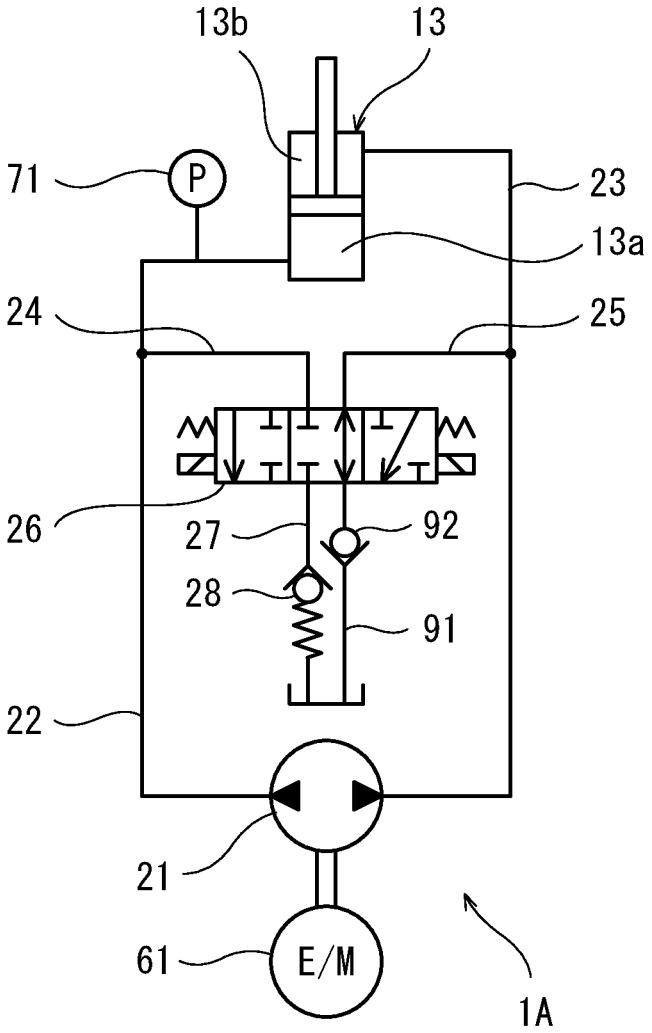
FIG. 3 shows a schematic configuration of a hydraulic excavator drive system in which the supply of hydraulic oil to a closed circuit for a boom cylinder is performed without using a second pump.

The supply of the hydraulic oil to the closed circuit for the boom cylinder 13 may be performed without using the second pump 31. This is realized by a hydraulic excavator drive system 1A shown in FIG. 3. In FIG. 3, the same components as those of the hydraulic excavator drive system 1 shown in FIG. 1 are denoted by the same reference signs as those used in FIG. 1, and repeating the same descriptions is avoided below.

In the drive system 1 shown in FIG. 1, the switching valve 26 is a three-port valve. However, in the drive system 1A shown in FIG. 3, the switching valve 26 is a four-port valve. The switching valve 26 is connected to the tank not only by the tank line 27, but also by a parallel line 91. A check valve 92, which allows a flow from the tank to the switching valve 26, but prevents the reverse flow, is located on the parallel line 91.

Similar to the above-described embodiment, the switching valve 26 is switched between the neutral position, the head-side discharge position (left-side position in FIG. 3), and the rod-side discharge position (right-side position in FIG. 3). When the switching valve 26 is in the neutral position, the switching valve 26 blocks the head-side branch line 24 and the tank line 27, and brings the rod-side branch line 25 into communication with the parallel line 91. When the switching valve 26 is in the head-side discharge position, the switching valve 26 blocks the rod-side branch line 25 and the parallel line 91, and brings the head-side branch line 24 into communication with the tank line 27. When the switching valve 26 is in the rod-side discharge position, the switching valve 26 blocks the head-side branch line 24 and the parallel line 91, and brings the rod-side branch line 25 into communication with the tank line 27.

In the drive system 1A shown in FIG. 3, similar to the above-described embodiment, the switching valve 26 is in the neutral position at a boom raising operation, switched to the rod-side discharge position at a boom lowering operation, and switched to the head-side discharge position at a vehicle body lifting operation. However, in the drive system 1A shown in FIG. 3, at the boom raising operation, the hydraulic oil in an amount corresponding to an insufficiency in the hydraulic oil due to an area difference between the head-side chamber 13*a* and the rod-side chamber 13*b* of the boom cylinder 13 is sucked from the tank into the first pump 21 through the parallel line 91 and the rod-side branch line 25.

Summary

A hydraulic excavator drive system according to the present disclosure includes: a first pump that is connected to a head-side chamber of a boom cylinder by a head-side line and to a rod-side chamber of the boom cylinder by a rod-side line to form a closed circuit; a second pump that supplies hydraulic oil to at least one of an arm cylinder or a bucket cylinder; and a switching valve located on a relay line that connects a supply line extending from the second pump to the rod-side line, wherein the switching valve opens the relay line at a boom raising operation and blocks the relay line except at the boom raising operation.

According to the above configuration, the relay line is connected to the rod-side line whose pressure is lowered at the boom raising operation. Accordingly, at the boom raising operation, motive power for the second pump, which supplies the hydraulic oil to the closed circuit for the boom cylinder, can be reduced.

A check valve that, at the boom raising operation, allows a flow from the second pump toward the rod-side line but prevents a reverse flow may be located at the relay line or the switching valve. According to this configuration, even when the boom raising operation is performed concurrently with an arm operation or a bucket operation, a reverse flow of the hydraulic oil at the relay line can be prevented.

The switching valve may be a first switching valve. The hydraulic excavator drive system may further include a second switching valve that is connected to the head-side line by a head-side branch line, to the rod-side line by a rod-side branch line, and to a tank by a tank line. The second switching valve may block the head-side branch line and the rod-side branch line at the boom raising operation, bring the rod-side branch line into communication with the tank line at a boom lowering operation, and bring the head-side branch line into communication with the tank line at a vehicle body lifting operation. According to this configuration, at the boom lowering operation, a part of the hydraulic oil discharged from the head-side chamber of the boom cylinder (i.e., an excess amount of the hydraulic oil in excess of the amount of the hydraulic oil flowing into the rod-side chamber) can be discharged to the tank after the excess amount of the hydraulic oil has passed through the first pump (in other words, after energy recovery), whereas at a vehicle body lifting operation, the excess amount of the hydraulic oil can be discharged to the tank before it passes through the first pump.

For example, the first pump may be driven by an electric motor. The hydraulic excavator drive system may further include: a boom operator including an operating lever that is operated in a boom raising direction and a boom lowering direction; and a controller that controls the electric motor, the first switching valve, and the second switching valve. When a regenerative current generated by the electric motor falls below a predetermined value during the operating lever of the boom operator being operated in the boom lowering direction, the controller may determine that the vehicle body lifting operation has started, and switch the second switching valve.

Alternatively, the first pump may be driven by an electric motor. The hydraulic excavator drive system may further include: a boom operator including an operating lever that is operated in a boom raising direction and a boom lowering direction; a pressure sensor that detects a pressure of the head-side chamber of the boom cylinder; and a controller that controls the electric motor, the first switching valve, and the second switching valve. When the pressure detected by the pressure sensor falls below a predetermined value during the operating lever of the boom operator being operated in the boom lowering direction, the controller may determine that the vehicle body lifting operation has started, and switch the second switching valve.

The invention claimed is:

1. A hydraulic excavator drive system comprising:

a first pump that is connected to a head-side chamber of a boom cylinder by a head-side line and to a rod-side chamber of the boom cylinder by a rod-side line to form a closed circuit;

a second pump that supplies hydraulic oil to at least one of an arm cylinder or a bucket cylinder; and a switching valve located on a relay line that connects a supply line extending from the second pump to the rod-side line, wherein the switching valve opens the relay line at a boom raising operation and blocks the relay line except at the boom raising operation, wherein a check valve that, at the boom raising operation, allows a flow from the second pump toward the rod-side line but prevents a reverse flow is located at the relay line or the switching valve.

2. A hydraulic excavator drive system comprising:

a first pump that is connected to a head-side chamber of a boom cylinder by a head-side line and to a rod-side chamber of the boom cylinder by a rod-side line to form a closed circuit;

a second pump that supplies hydraulic oil to at least one of an arm cylinder or a bucket cylinder; and a switching valve located on a relay line that connects a supply line extending from the second pump to the rod-side line, wherein the switching valve opens the relay line at a boom raising operation and blocks the relay line except at the boom raising operation, wherein the switching valve is a first switching valve, the hydraulic excavator drive system further comprises a second switching valve that is connected to the head-side line by a head-side branch line, to the rod-side line by a rod-side branch line, and to a tank by a tank line, and the second switching valve blocks the head-side branch line and the rod-side branch line at the boom raising operation, brings the rod-side branch line into communication with the tank line at a boom lowering operation, and brings the head-side branch line into communication with the tank line at a vehicle body lifting operation.

3. The hydraulic excavator drive system according to claim 2, wherein the first pump is driven by an electric motor, the hydraulic excavator drive system further comprises:

a boom operator including an operating lever that is operated in a boom raising direction and a boom lowering direction; and a controller that controls the electric motor, the first switching valve, and the second switching valve, and when a regenerative current generated by the electric motor falls below a predetermined value during the operating lever of the boom operator being operated in the boom lowering direction, the controller determines that the vehicle body lifting operation has started, and switches the second switching valve.

4. The hydraulic excavator drive system according to claim 2, wherein the first pump is driven by an electric motor, the hydraulic excavator drive system further comprises:

a boom operator including an operating lever that is operated in a boom raising direction and a boom lowering direction;

a pressure sensor that detects a pressure of the head-side chamber of the boom cylinder; and a controller that controls the electric motor, the first switching valve, and the second switching valve, and when the pressure detected by the pressure sensor falls below a predetermined value during the operating lever of the boom operator being operated in the boom lowering direction, the controller determines that the vehicle body lifting operation has started, and switches the second switching valve.

* * * * *